United States Patent [19]

Davison

[11] Patent Number: 4,527,472

[45] Date of Patent: Jul. 9, 1985

[54] EXCHANGEABLE PRINT HEAD HOT INK ROLL MARKER

[75] Inventor: Charles F. Davison, Brookfield, Ill.

[73] Assignee: Norwood Marking & Equipment Co., Inc., Downers Grove, Ill.

[21] Appl. No.: 535,997

[22] Filed: Sep. 26, 1983

[51] Int. Cl.[3] ..... B41F 13/44; B41F 5/04; B41B 1/18

[52] U.S. Cl. ..... 101/219; 101/377; 101/394; 101/398; 101/27

[58] Field of Search ..... 101/377, 381, 380, 370, 101/28, 394, 390, 391, 392, 393, 374, 375, 376, 378, 382 MV, 216, 219, 228, 329, 25, 35, 407 A, 153, 398, 399

[56] References Cited

U.S. PATENT DOCUMENTS

| | | | |
|---|---|---|---|
| 454,862 | 6/1891 | Godwin | 101/398 |
| 643,987 | 2/1900 | Schock | 101/241 |
| 921,974 | 5/1909 | Ginsburg | 101/28 |
| 982,579 | 1/1911 | Doremus | 101/238 |
| 1,078,400 | 11/1913 | Allen | 101/398 |
| 1,176,204 | 3/1916 | Crabbs | 101/398 |
| 1,206,785 | 11/1916 | Hebert | 101/381 X |
| 1,225,712 | 5/1917 | Hoskins | 101/381 X |
| 1,485,270 | 2/1924 | Keller | 101/219 |
| 1,687,635 | 10/1928 | Putnam | 101/381 X |
| 1,916,661 | 7/1933 | Flothow | 101/25 |
| 1,987,370 | 1/1935 | Pleger | 101/381 |
| 2,009,414 | 7/1935 | Roberts, Jr. | 101/381 |
| 2,072,909 | 3/1937 | Stephenson | 101/378 |
| 2,163,035 | 6/1939 | Grupe | 101/248 |
| 2,289,394 | 7/1942 | Ungar | 83/299 |
| 2,374,096 | 4/1945 | Heywood et al. | 101/350 |
| 2,723,621 | 11/1955 | Payne | 101/377 |
| 2,805,436 | 9/1957 | Christensen et al. | 101/329 |
| 2,835,195 | 5/1958 | Jackson | 101/219 |
| 2,996,001 | 8/1961 | Schlegel et al. | 101/228 X |
| 3,021,783 | 2/1962 | Casey | 101/35 |
| 3,259,063 | 7/1966 | Rothman | 101/398 X |
| 3,358,599 | 12/1967 | Douglass, Sr. | 101/394 |
| 3,487,776 | 1/1970 | Marozzi | 101/219 |
| 3,598,050 | 8/1971 | Thompson | 101/216 |
| 3,998,156 | 12/1976 | Zimmer | 101/118 |
| 4,109,790 | 8/1978 | Gottschlich | 101/376 X |
| 4,129,074 | 12/1978 | Beaver et al. | 101/35 |
| 4,373,444 | 2/1983 | Cunnington | 101/228 |

FOREIGN PATENT DOCUMENTS

| | | | |
|---|---|---|---|
| 321877 | 6/1920 | Fed. Rep. of Germany | 101/375 |
| 55-865 | 4/1980 | Japan | 101/219 |
| 482010 | 3/1938 | United Kingdom . | |
| 715732 | 9/1954 | United Kingdom | 101/248 |

*Primary Examiner*—Clifford D. Crowder
*Attorney, Agent, or Firm*—Hill, Van Santen, Steadman & Simpson

[57] ABSTRACT

An exchangeable print head hot ink roll marker providing for adjustment of an inking roll and a backing roller relative to print heads of different diameters. Additionally there are provided a novel arrangement for releasably securing the print head to its driving shaft, an improved arrangement for adjusting the backing roll relative to the print head, novel type holder arrangements, and novel type holder latching or magnetic retaining structures.

24 Claims, 17 Drawing Figures

FIG. 3
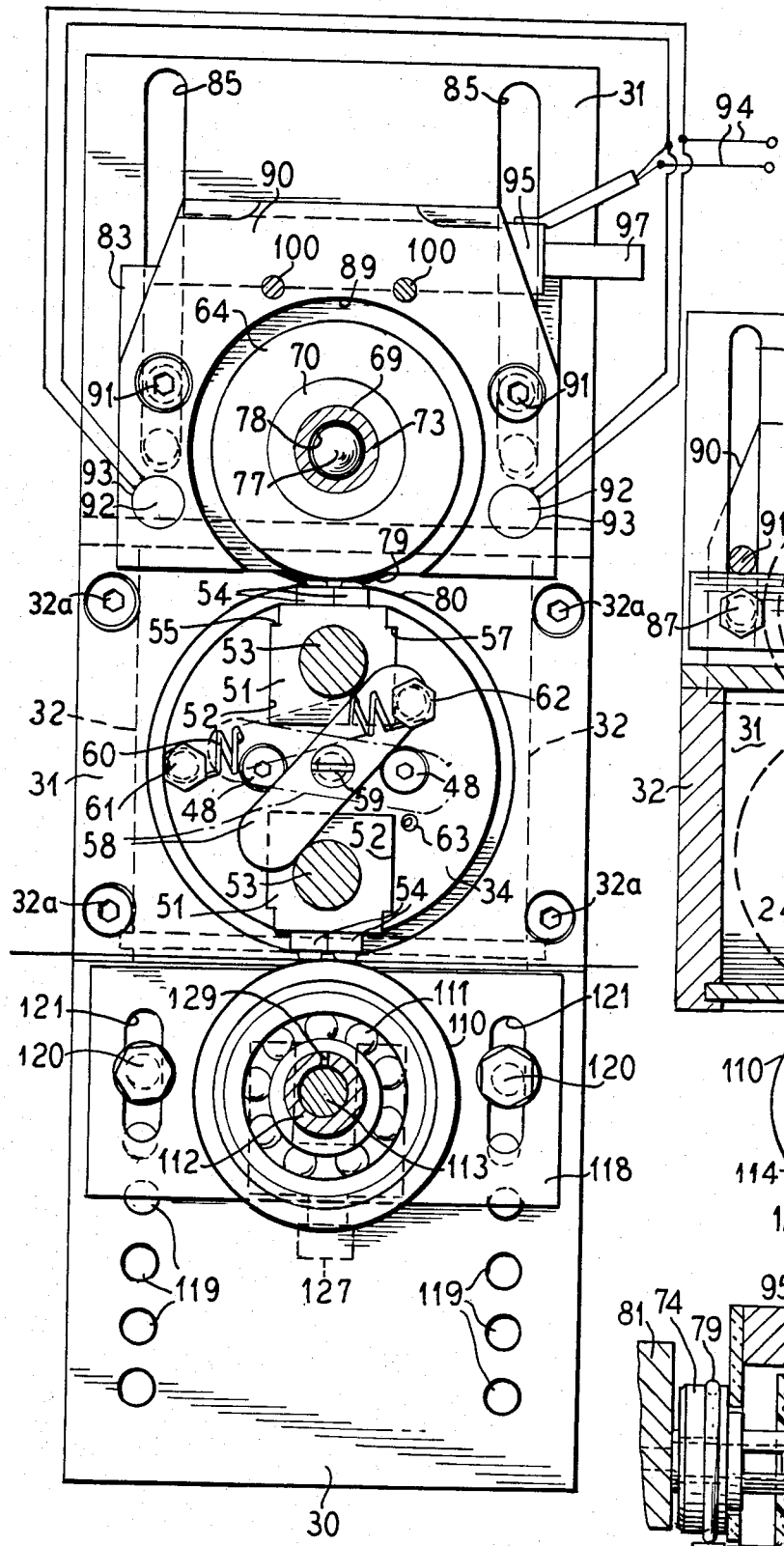
FIG. 4
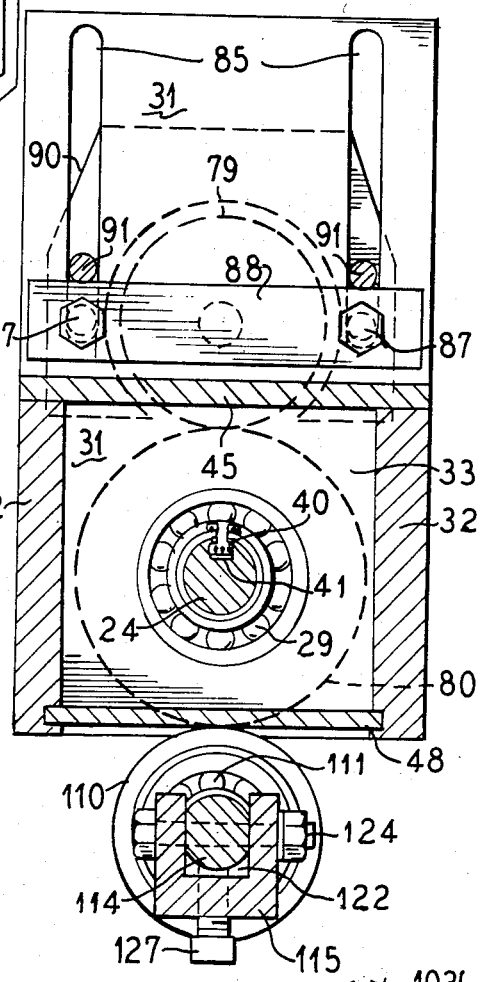
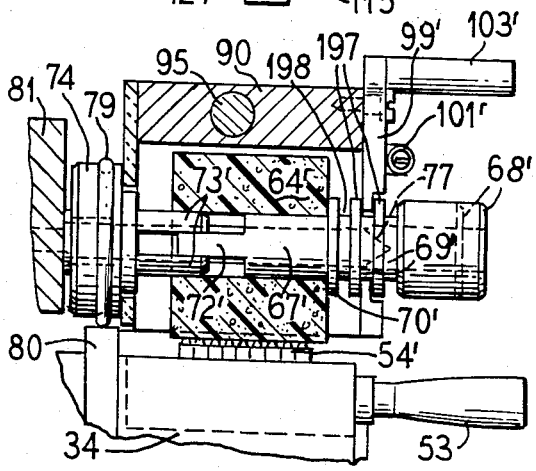
FIG. 4A

FIG. 6
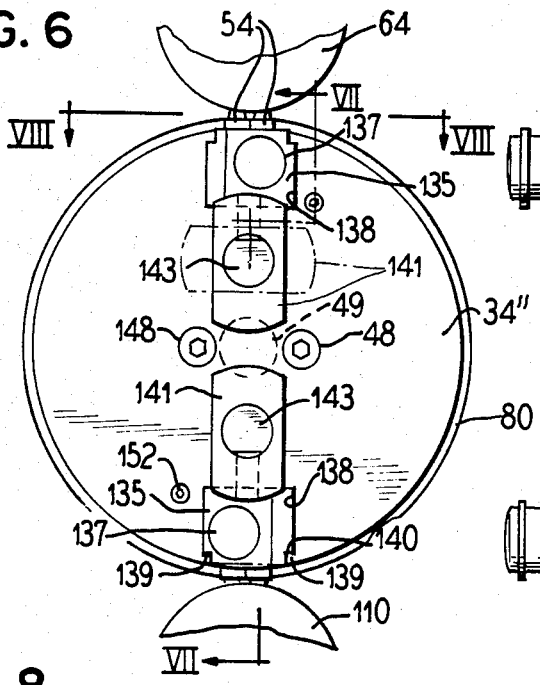
FIG. 7
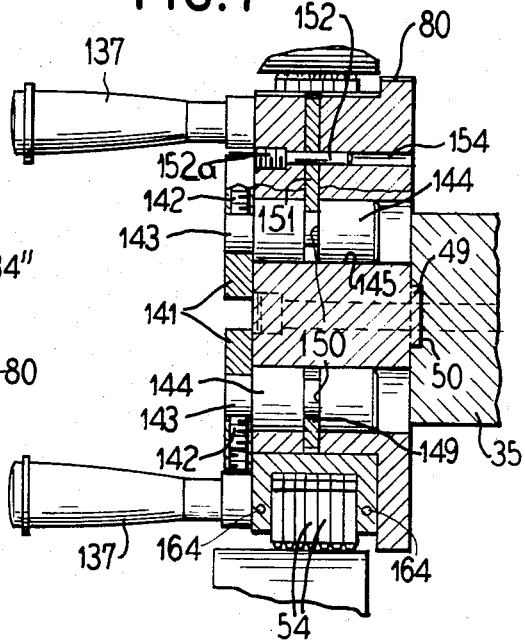
FIG. 8
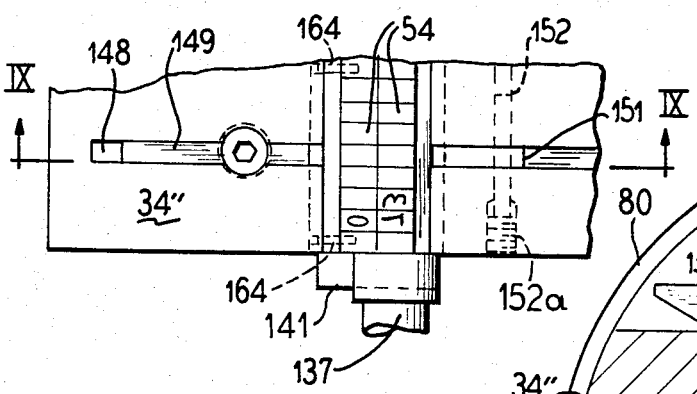
FIG. 9
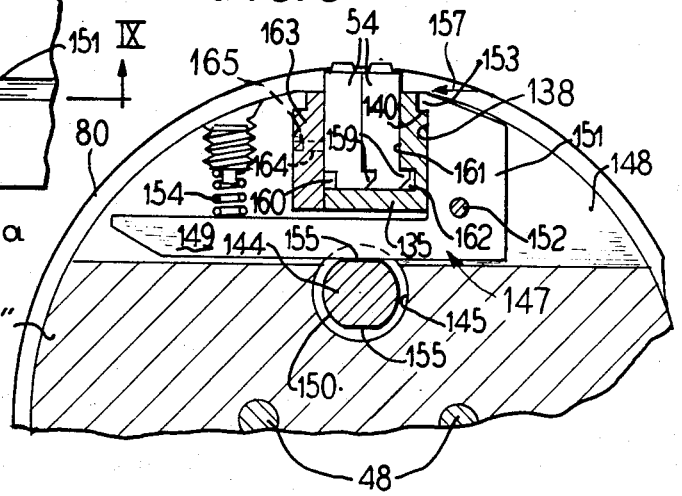
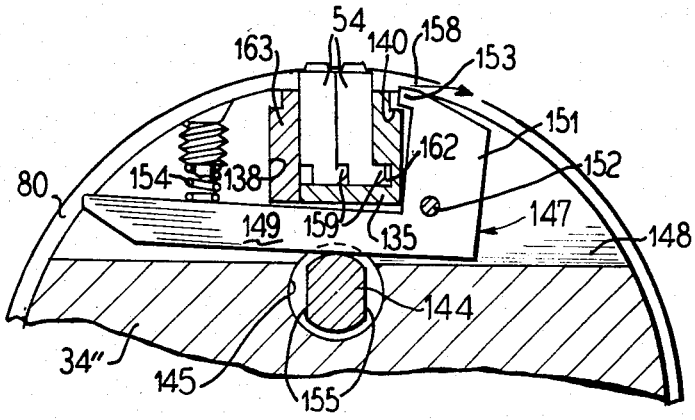
FIG. 10

FIG. 11
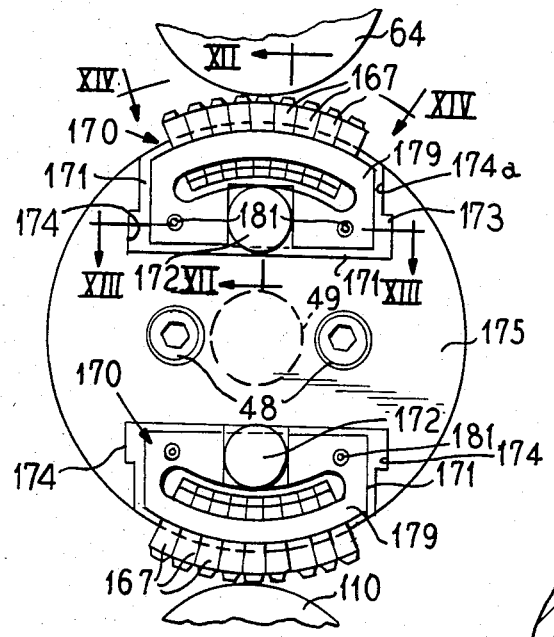
FIG. 12
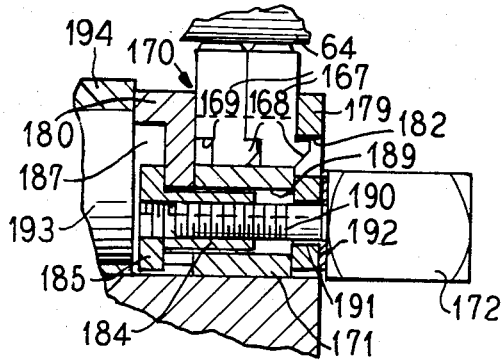
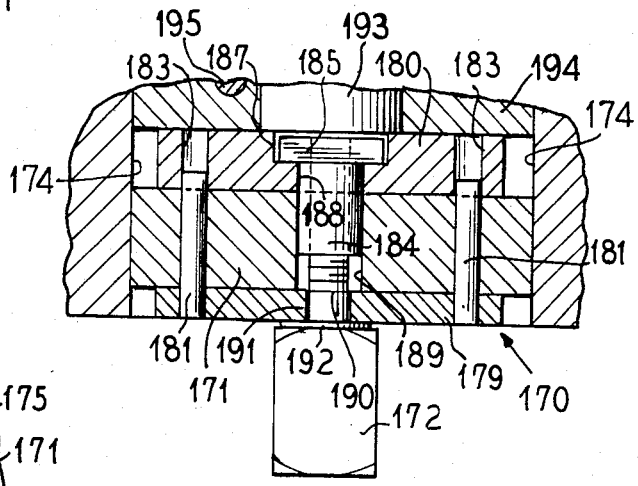
FIG. 14
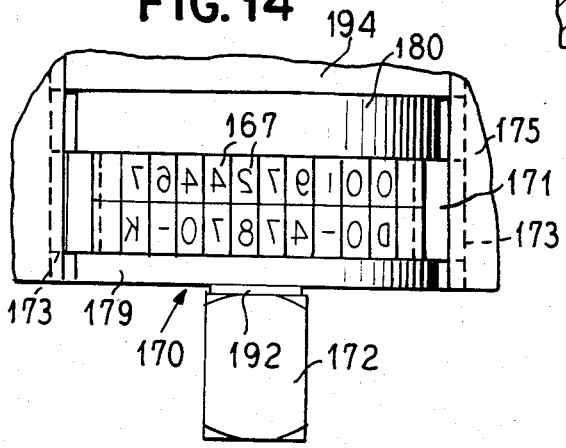
FIG. 13
FIG. 15
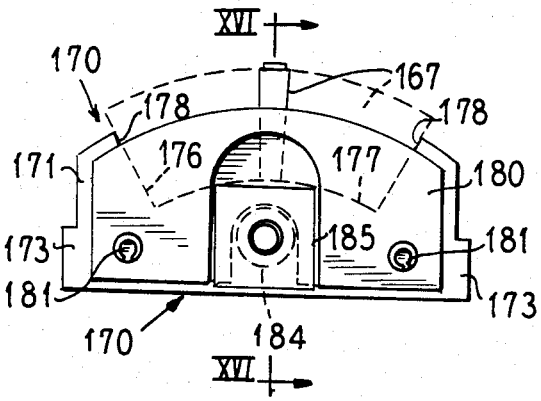
FIG. 16
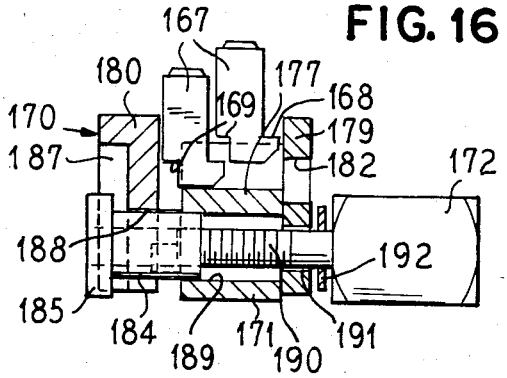

EXCHANGEABLE PRINT HEAD HOT INK ROLL MARKER

BACKGROUND OF THE INVENTION

1. Field of the Invention

This invention relates to marking devices and is more particularly concerned with rotary head markers for imprint on a moving workpiece, e.g. a strip of bag material, or the like.

2. Prior Art

Rotary head imprinters are used in industry for imprinting indicia on a workpiece such as bag making material in strip form, and the like. A common type of such rotary head imprinters includes a rotatably driven head carrying printing indicia such as type bars with the type exposed at the circumference of the print head for successively contacting an inking roll and then the workpiece which travels on a backing roll. Such imprinters may be associated with a packaging or filling machine or may be employed to imprint the film which is then wound into a roll for subsequent use. This type of imprinter may be employed to imprint small or selected areas of preprinted film panels where the film strip comprises a longitudinally extending series of the panels which will subsequently form individual faces of bags or packages.

With some frequency, it may be necessary to change the type carried by the print head for different imprinting runs. It may also be necessary from time-to-time to vary the size or the transverse location of the imprinting, or the spacing of the imprints along the length of the workpiece such as bag making film strips, or the like.

Heretofore such adjustments have involved complex mechanisms and manipulations with attendant loss of production time, and costly manpower demands.

SUMMARY OF THE INVENTION

An important object of the present invention is to provide a new and improved rotary head imprinter which will overcome the disadvantages, drawbacks, inefficiencies, shortcomings and problems inherent in prior rotary head imprinters and will greatly facilitate various adjustments and accommodations in such imprinters.

Among the various aspects of the invention are provisions for accommodating print heads of a substantial range of different diameters, a novel arrangement for releasably securing the print head to its driving shaft, an improved arrangement for adjusting the backing roller as well as the inking roll relative to the print head, means to facilitate mounting and replacement of type holders in the print head, and improvements in the type holders.

According to the present invention there is provided a new and improved rotary head imprinter including a frame and embodying any or all of the following aspects:

A supporting frame, a shaft rotatably supported by the frame and means for rotatably driving the shaft, means for replaceably securing a rotary print head to the shaft, a rotary inking roll and means for mounting the inking roll on the frame on an axis parallel to the axis of the shaft for rolling inking engagement with printing means carried by the print head, a backing roller and means for mounting the backing roller on the frame on a rotary axis parallel to the shaft axis for supporting a workpiece for imprinting by the inked printing means carried by the printing head, and means for effecting adjustments of the inking roll mounting means and the backing roller mounting means radially relative to the shaft for enabling cooperation of the inking roll and the backing roller with printing heads of selected different diameters.

A shaft rotatably supported by the frame and means for rotatably driving the shaft, a print head mounting block carried by the shaft, and means for releasably securing the print head to the mounting block.

Means for mounting the backing roller on the frame and comprising a non-rotating shaft, a tubular eccentric slidably engaged on the non-rotating shaft and providing means for rotatably supporting the backing roller, the eccentric being selectively rotatably adjustable on the non-rotating shaft for adjusting the backing roller relative to the print head, and a combination adjusting knob and locking clamp on one end of the eccentric for locking the eccentric in any selected rotatably adjusted position on the non-rotating shaft.

Means on the print head providing an axially extending and peripherally radially opening slot having an entrance at a front face of said print head for receiving a type holder, means for retaining the type holder against radial displacement from the slot, and latch means movably manipulatable at the front face of the print head for releasably retaining the type holder against axial displacement from the slot.

A type holder adapted to be mounted on the print head, and comprising a type holder body adapted for mounting on the print head and having a cavity defined by a base wall and spaced end walls and adapted for supporting printing bar means on the base wall between the end walls, means providing opposite printing bar means retaining side walls for the cavity, means for locking the printing bar means in the cavity, at least one of the side walls being separable from the body to permit mounting and replacement of the printing bar means in the cavity, and means for releasably retaining said one side wall in assembled relation with the body.

BRIEF DESCRIPTION OF THE DRAWINGS

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

FIG. 3 is an enlarged fragmentary sectional elevational view taken substantially along the line III—III of FIG. 2;

FIG. 4 is an enlarged fragmentary vertical sectional elevational view taken substantially along the line IV—IV of FIG. 2;

FIG. 4A is a fragmentary longitudinal sectional elevational detail view showing a modification of the inking roll.

FIG. 6 is a fragmentary front elevational view showing a relatively large diameter print head;

FIG. 7 is a sectional detail view taken substantially along the line VII—VII of FIG. 6;

FIG. 8 is a fragmentary top plan view taken substantially in the plane of line VIII—VIII of FIG. 6;

FIG. 9 is a sectional elevational detail view taken substantially along the line IX—IX of FIG. 8;

FIG. 10 is a view similar to FIG. 9 but showing the type holder unlocked;

FIG. 11 is a front elevational view similar to FIG. 6 but showing another modification;

FIG. 12 is a fragmentary sectional elevational view taken substantially along the lines XII—XII of FIG. 11;

FIG. 13 is a fragmentary top plan sectional view taken substantially along the line XIII—XIII of FIG. 11;

FIG. 14 is an enlarged fragmentary top plan view taken substantially in the plane of line XIV—XIV of FIG. 11;

FIG. 15 is a rear elevational view of the type holder of FIG. 11; and

FIG. 16 is a sectional elevational detail view taken substantially along the line XVI—XVI of FIG. 15.

DETAILED DESCRIPTION

Figure 1:
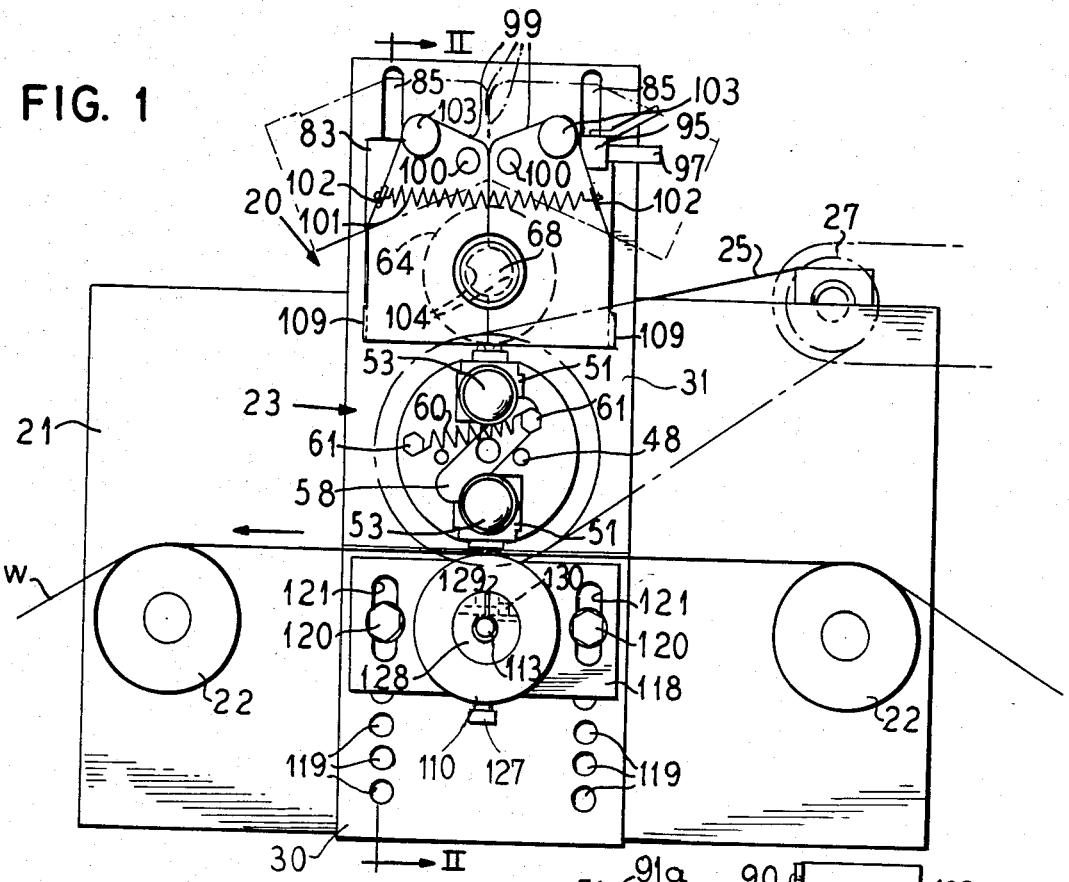
FIG. 1 is a front elevational view of a rotary head imprinter embodying the invention.

A rotary head imprinter 20 (FIG. 1) is adapted to be carried by or in association with apparatus 21 which may support spaced apart guide rollers 22, one on each side of the imprinter 20 and over which a workpiece W such as carton flap, a web, film strip, bag making film, web or strip material may be adapted to travel from any suitable source to a disposition point such as a winder, bag making machine, bag filling machine, or the like. For example, where the imprinter 20 is used in connection with bag forming and filling means, last minute information such as code dating or pricing may be imprinted in designated panel areas of a pre-printed bag making film. While the imprinter 20 is desirably adapted for continuous printing operation where the workpiece W is caused to run continuously through the imprinter, the imprinter is adapted to be operated intermittently where starting and stopping movement of the workpiece W is necessary for the particular type of utilization of the imprinted material.

In a preferred embodiment, the imprinter 20 comprises a frame 23 which rotatably supports a shaft 24 (FIG. 2) adapted to be driven rotatably by a drive assembly including an endless driving element such as a chain 25 which is driven as by means of a transmission 27 powered by any suitable means (not shown) which may be common to the means for driving the workpiece W. At the shaft 24, the driving power input chain 25 is trained over a sprocket 28 keyed to the shaft 24.

Antifriction bearings 29 support the shaft rotatably in spanning relation on and between spaced parallel vertical panels of the frame 23, comprising a lower rear panel 30 and a front upper panel 31. The upper portion of the panel 31 extends upwardly in rearwardly offset spaced relation to the lower portion of the panel 31 and the panels are secured together along opposite vertical edges by means of spaced parallel vertical connecting panels 32 (FIG. 3) which are fastened in place by means of screws 32*a*. The connecting panels 32 extend in a front to rear direction and define with the panels 30 and 31 a chamber 33 through which the shaft 24 extends. The portion of the shaft extending rearwardly from the panel 30 carries the drive means sprocket 28, and a portion of the shaft which projects forwardly from the frame panel 31 has replaceably attached thereto a rotary print head 34.

For releasably mounting the print head 34 on the shaft 24, the forward end of the shaft carries integrally thereon, or at least functionally integrally, a print head mounting block 35 which also serves as a heater for the printing head. For this purpose the block 35 carries one or more cartridge type heating elements 37 connected to an electrical power or energy source through thermostat means 38 and terminal block means 39 on the block 35. Electrical wiring 40 for the heaters extends along a longitudinal channel 41 in the shaft perimeter and is connected to electrical take-off or slip rings 42 mounted on a dielectric sleeve 43 carried fixedly on the shaft 24 within the chamber 33. Electrical brushes 44 carried by a top closure panel 45 over the chamber 33 are electrically connected to a suitable power source at a junction box 47 mounted on the panel 45. The bottom of the chamber 33 is desirably closed by a panel 48 which has edges engaged in grooves in the frame panels 30 and 31.

Figure 2:
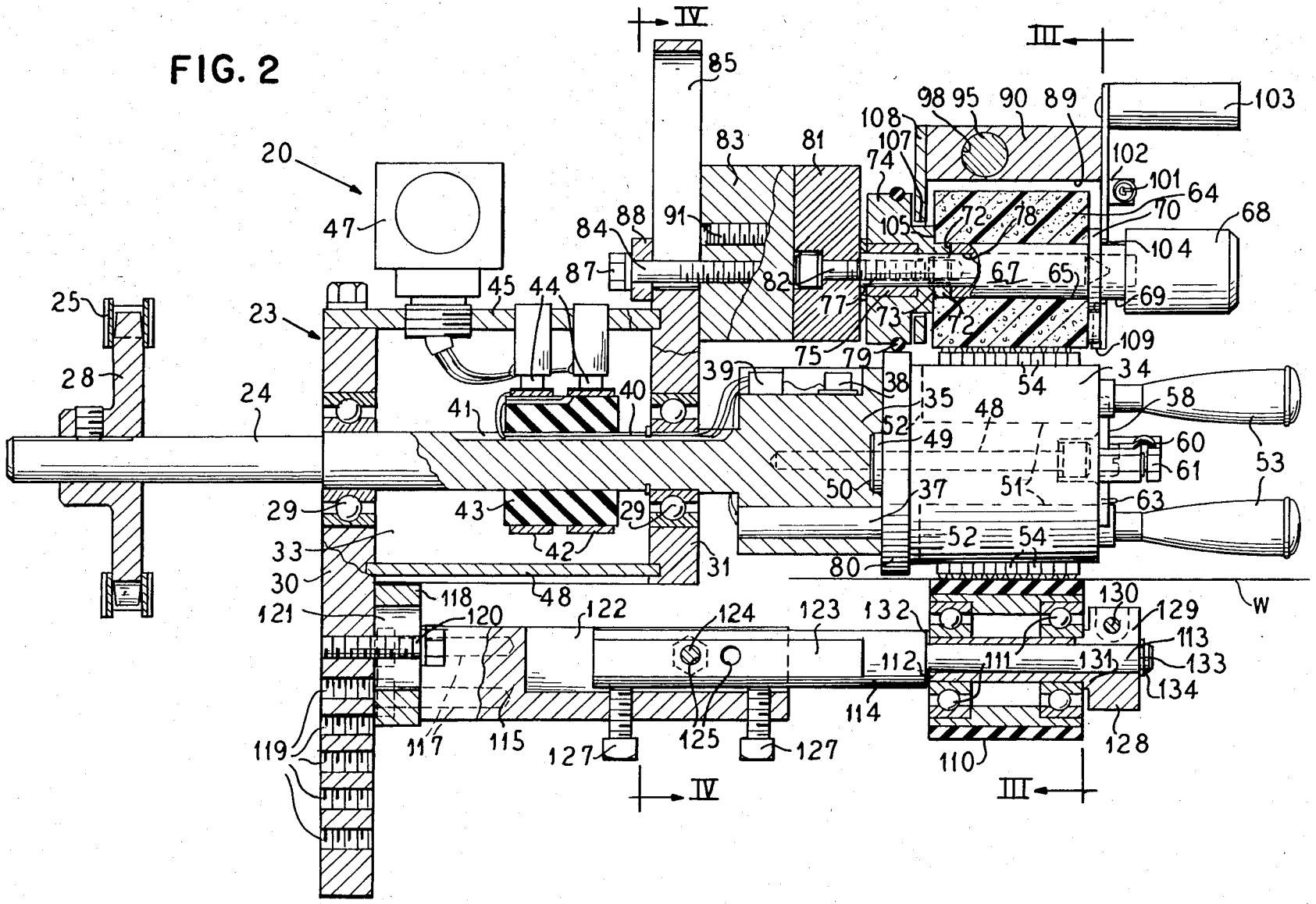
FIG. 2 is an enlarged vertical sectional detail view taken substantially along the line II—II of FIG. 1.

Separable mounting of the print head 34 on the block 35 and concentric with the shaft 24, is desirably effected by engaging a rear face on the print head in heat transfer relation against a front face of the block 35. Securing of the print head to the mounting block is effected by means of a pair of preferably recessed-head bolts 48 (FIGS. 1–3). Centering, coaxial alignment of the print head 34 with the shaft 24 is desirably indexed by means of a cylindrical boss 49 projecting rearwardly from the head 34 and received in a complementary cylindrical indexing socket 50 in the front face of the mounting block 35. To insure concentricity, the boss 49 fits in close slidable engagement in the socket 50.

Means are provided in the print head 34 for mounting one or more, and in this instance two, type holders 51 at diametrically opposite sides of the head. Each of the type holders comprises a body of preferably elongate rectangular cross section adapted to be received slidably in respective axially extending and peripherally radially opening, rearwardly blind end socket slots 52 in the head 34 and each having an entrance at the front face of the print head for receiving the respective type holder 51 by an axially inward maneuver assisted by a respective handle 53 extending forwardly on each of the type holders. Type bars 54 are carried by the holders 51 and project from the perimeter of the head 34. Retention of the type holders 51 against radial displacement from the head 34 is effected by dovetail means comprising stepped shoulders 55 on each of the type holders engaged by cooperating radially inwardly facing retention shoulder 57 at the radially outer side of the socket 52 in each instance.

Unintended axially outward displacement of the type holders 51 from the sockets 52 is prevented by releasable latch means carried by the head 34. In one preferred arrangement, the latch means comprises a latch bar 58 mounted equidistantly between its ends on a pivot 59 on the front face of the head 34 midway between and in diametric alignment with the holders 51 and more particularly the handles 53. The latch bar 58 is of sufficient length to be swiveled between a non-latching position, as shown in phantom outline in FIG. 3, and the full line position wherein the latch bar extends in latching, retaining relation across the outer ends of the mounted type holders 51. The width of the bar 58 is less than the space between the root surfaces of the sockets 52, so that for mounting and removal of the type holders the latch bar is swung to the nonlatching position generally parallel to, and clear of the root surfaces as indicated in the phantom outline in FIG. 3.

For retaining the latch bar 58 in the latching position, biasing means in the form of a tension spring 60 is provided attached at one end to an anchor 61 on the face of the head 34 spaced radially outwardly from the pivot 59 on a diameter midway between the root surfaces of the sockets 52 and in clearance relation to the tip of the latch bar 58 when in the open or holder releasing position. At its opposite end the biasing spring 60 is attached to an anchor 62 on the outer face of the latch bar 58 and adjacent to the end of the latch bar remote from the anchor 61. The anchor 62 is offset from the longitudinal axis of the latch bar in a direction away from the fixed anchor 61, that is toward the down side of the latch bar as seen in FIG. 3. Through this arrangement, the spring 61 is an overcenter spring which in the latching position of the latch bar 58 biases the latch bar into the latching relation to the adjacent ends of the type holders 51 and into stopped engagement with the base and portion of one of the handles 53. When the latch bar 58 is swung toward the open position, the overcenter spring 60 acts through the anchor 62 for retaining the latch bar in the open position stopped against a stop shoulder 63 provided as by means of a pin projecting for this purpose from the outer face of the print head 34. Thereby, quick and easy access for removal and replacement of the type holders 51 is afforded. Upon returning the latch bar 58 to its latching position the type holders are positively retained in the print head 34.

For inking the type faces of the type bars 54, there is provided a rotary inking roll 64 which is mounted on the frame panel 31 preferably above the print head 34 and on an axis parallel to the axis of the shaft 24 for rolling engagement with the printing bar type faces. The roll 64 comprises a porous elastomeric sleeve impregnated with a heat liquifiable imprinting ink and its inner diameter 65 is adapted to be frictionally slidably received on a hub 67 having at its outer end a handle 68. Adjacent to the inner end of the handle 68 and spaced therefrom by a neck groove 69 is an integral annular thrust shoulder flange 70 on the hub 67 which is adapted to engage the outer end of the inking roll sleeve 64. At its inner end, the hub 67 has rearwardly extending clutch lugs 72 which interlock with complementary clutch slots 73 in the forward end of a driving wheel 74 having a bushing bearing 75 engaging rotatably about a cantilever axle 77 which extends through the wheel 74 and to a substantial extent into a journal bore 78 in the hub 67. Through this arrangement the hub 67 and thereby the inking roll 64 is adapted to be driven rotatably by engagement of a friction tread in the form of an elastomeric O-ring 79 mounted on the perimeter of the wheel 74 and engaging a driving rim 80 integral with the inner end of the rotary printing head 34. The rim 80 is of suitable diameter in relation to effective type diameter to insure proper contact between the type and the inking roll.

In a preferred arrangement, the axle 77 is mounted to a block 81 as by means of an attachment screw 82. In support of the block 81 is a mounting block 83 which is attached to an upstanding portion of the front wall frame plate 31 by means of a pair of horizontally spaced attachment screws 84 which extend through vertical adjustment slots 85 in the plate 31. Heads 87 of the screws 84 are accessible at the rear of the frame plate 31 and are adapted to be drawn up against a spanner bar 88 which bridges the vertical slots 85. Through this arrangement, the assembly comprising the inking roll 64 is adapted to be vertically adjusted throughout a substantial range simply by loosening the screws 87 and moving the inking assembly up or down to accommodate print heads of different diameters as is well visualized on comparison of FIGS. 2 and 5 wherein the print head 34 is of relatively small diameter as compared with the print head 34' of FIG. 5 which is of substantially larger diameter.

For heating the inking roll 64, it is housed within a chamber 89 in a thermal block 90 (FIGS. 2 and 3). Mounting of the thermal block 90 to the mounting block 83 is effected by means of screws 91 the heads of which are accessible at the front of the block 90 and which have long shanks extending through the block 90 and through thermal barrier spacers **91*a* (FIG. 5) and thence through the block 81 and the terminal portions of the screws secured threadedly into the mounting block 83. The spacers 91*a* are dimensioned to maintain a proper clearance between the back of the thermal block 90 and the front face of the block 81 to accommodate the drive wheel 74. Desirably the spacers 91*a*** are formed from a material which is a poor heat conductor, such as stainless steel.

Means for maintaining controlled ink heating temperature within the chamber 89 comprise a pair of cartridge heaters 92 mounted in respective sockets 93 in the block 90 desirably adjacent to opposite side of the chamber 89 and near the lower opening from the chamber 89 where the inking roll 64 is exposed to contact with the indicia on the type bars 54, as best seen in FIG. 3. Energizing of the heaters 92 is effected through suitable electrical circuitry, schematically illustrated in FIG. 3, and receiving electrical power from a suitable source 94. Heat output of the heaters 92 and thereby the ink heating action of the thermal block 90 is controlled as by means of a thermostatic thermal-control 95 connected in the heater circuit. In a desirable arrangement, the control 95 may be in the form of a cartridge having a manipulating handle 97 by which the cartridge is adapted to be received in or removed from a socket 98 provided for this purpose in the block 90. It will be understood, of course, that the electrical circuit for the heaters 92 may be controlled in any preferred manner according to common practice, as also the electrical circuitry for the print head heater or heaters 37.

In order to facilitate initial mounting and retention of the inking roll 64 in the chamber 89, and to facilitate from time-to-time replacement of the inking roll such as for replenishing the ink supply or changing the pigment color of the ink, or the like, the inking roll is adapted to be carried into and removed from the chamber 89 on the hub 67. This hub, as already explained, is slidably received on the axle 77 and is clutchingly engageable with the driving wheel 74. Means for not only retaining the inking roll hub 67 within the chamber 89, but also for closing the front of the chamber 89, comprises a cooperating pair of pivotally mounted latch/door members 99 of mirror image construction and comprising flat coplanar plates mounted pivotally on the front face of the block 90. Respective pivots 100 at the upper ends of the members 99 and located adjacent to their meeting edges are located at such a position above the entrance into the chamber 89 that the plates can be swung from the full line closed position in FIG. 1 to the dash outline position wherein the plates clear the entrance to the chamber 89 for full manipulative access to the inking roll 64. To implement this action each of the plates 99 has its edge adjacent to the pivots 100 shaped as on a radius complementary to the radius of curvature of the other plate to afford relative swinging movement clearance. Normally the latch door plates 99 are biased into the closing relation by means of a tension spring 101 anchored at its opposite ends to anchoring lugs or ears 102 on the remote edges of the plates and on an axis extending intermediate the pivots 100 and the handle 68.

At their upper ends and offset from the pivots 100, the latch door plates 99 have respective manipulating handles 103 which can be grasped by the thumb and forefinger of a hand and pulled toward one another whereby to swing about the pivots 100 and against the bias of the spring 101 for opening the entrance into the chamber 89. Intermediate the length of their meeting edges, the plates 99 have respective notches 104 for clearing the neck 69 of the hub handle 68 whereby in the closed relation of the members 99 they act as a latch engaging at the outer side of the collar flange 70 for retaining the hub 67 and thereby the inking roll 64 in place within the chamber 89. It will be observed in FIG. 2 that as thus latched in place, the inking roll 64 is held in its axial operating position between the shoulder flange 70 and a complementary shoulder 105 on a boss on the driving wheel 74 projecting inwardly through a clearance port 107 on a chamber closing plate 108 secured to the rear face of the thermal block 90. Desirably stabilizer stop lug flanges 109 (FIGS. 1 and 2) at the lower ends of the outside edges of the plates 99 are adapted to engage the confronting sides of the block 90 in the closed condition of the plates, and adapted for restraining the latch plates 99 against crowding or binding the hub 67.

For supporting the workpiece W in position to be imprinted by the indicia on the type bars 54 carried by the print head 34, a backing roller 110 is mounted rotatably under the print head as visualized in FIGS. 1, 2 and 3. In a desirable form, the roller 110 is rubber covered and supported on antifriction bearings 111 mounted about a tubular eccentric 112 supported on a spindle shaft or axle 113 projecting as an extension forwardly from a mounting bar 114 and desirably in one piece with this bar. The bar 114 is supported by a cantilever arm 115 secured at its rear end as by means of screws 117 to a mounting plate 118 which is elongated horizontally (FIG. 1) and at its opposite end portions overlaps respective vertically extending series of tapped bolt holes 119. Attachment screws 120 extend through vertical adjustment slots 121 in the end portions of the plate 118 and are selectively threadedly engaged in the bolt holes 119. Through this arrangement the mounting plate is adapted to be attached at various elevations to the frame plate 30 by selection of the bolt holes 119, as exemplified in FIGS. 2 and 5, for accommodating different diameters of print heads.

After a general or coarse vertical adjustment of the backing roller assembly has been effected by selection of the appropriate bolt holes 119, fine adjustment can be effected by vertically adjusting the mounting plate 118 with respect to the bolts 120 along the slots 121, and tightening of the bolts 120 then holds the mounting plate 118 at the desired elevation.

Additional fine or trimming adjustments of the backing roll 110 are adapted to be effected by having the axle shaft bar 114 rockably mounted on the arm 115. For this purpose, the bar 114 is received in a longitudinally extending upwardly opening slot 122 in the forward end portion of the arm 115, with parallel flatted sides 123 of the bar 114 slidably engaging side walls defining the slot 122. A pivot pin 124 may be in the form of a screw, as shown, extending through and between the side walls defining the slot 122 and through a selected one of a pair of transverse journal bores 125 extending through the bar 114 between the flats 123 and in longitudinally spaced relation along the bar. Adjustment of the vertical attitude of the bar 114 is adapted to be effected and maintained by means of a pair of cooperating set screws 127 threaded upwardly, at longitudinally spaced points and at opposite sides of the pivot 124, through the arm 115 into the root of the slot 122 and into engagement with the underside of the bar 114.

After a coarse vertical adjustment and a secondary vertical adjustment has been effected by means of the screws 120, and a first stage fine adjustment has been effected by means of the set screws 127, a final fine adjustment is adapted to be effected by means of the eccentric 112. This final adjustment is desirable to obtain the optimum backing attitude of the backing roll 110 to the imprinting indicia of the type bars 54 of the print head 34. To facilitate the eccentric adjustment, it is provided on one end with a knob 128 which also serves as a locking clamp and for this purpose has a longitudinally extending slot 129 therein extending entirely through to the tubular bore of the eccentric 112 with which the knob is preferably formed integrally in one piece. By tightening a drawup locking screw 130 extending across the slot 129 of the split knob, the knob is adapted to be clamped firmly onto the axle shaft 113. At its inner end, the knob 128 is desirably provided with a rearwardly projecting limited contact shoulder 131 which is adapted in cooperation with a cooperating shoulder 132 on the bar 114 to maintain the backing roller 110 in proper alignment with the print head 34. For security purposes, the outer end portion of the axle shaft 113 may be provided with a snap ring groove 133 within which a retaining snap ring 134 is adapted to be received.

Figure 5:
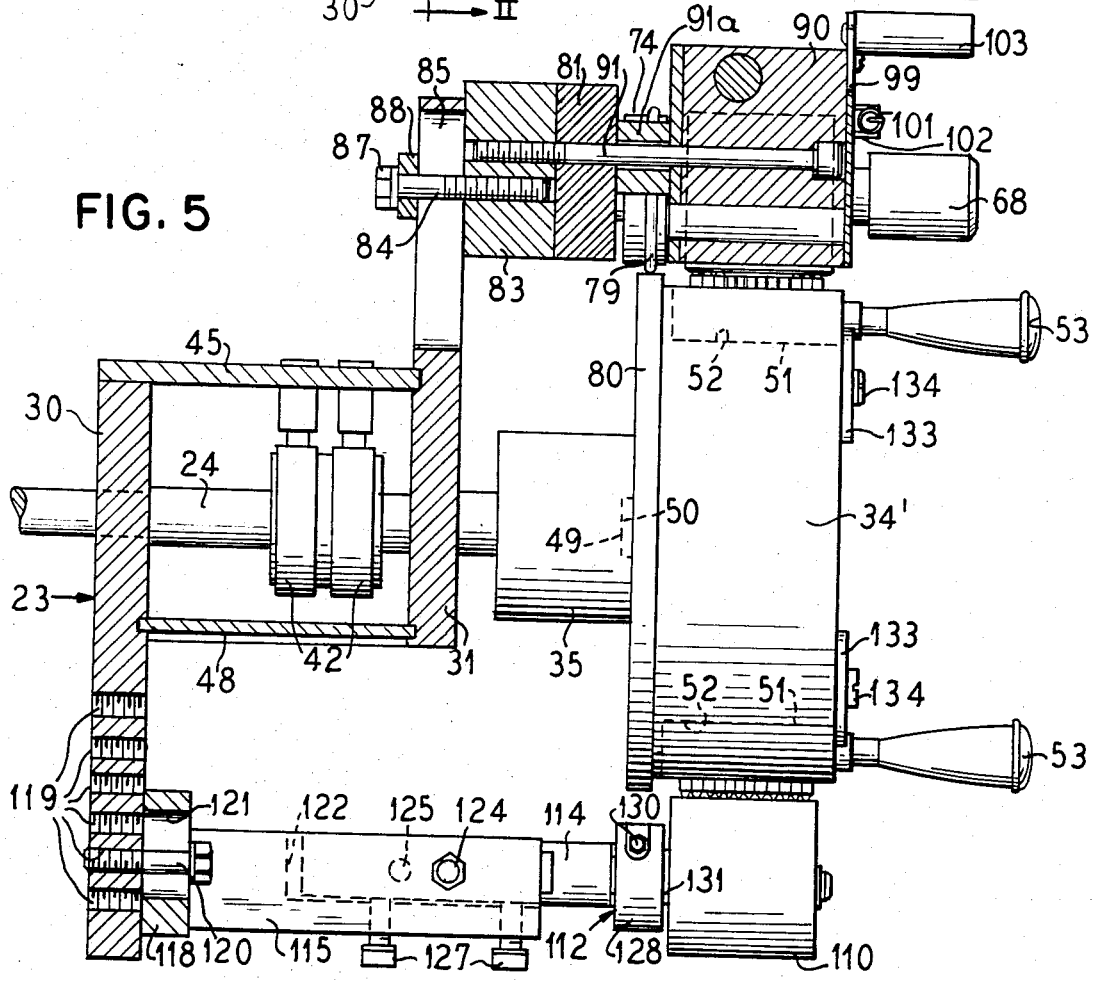
FIG. 5 is a fragmentary vertical sectional detail view similar to FIG. 2 but showing adjustment for a larger diameter print head.

On comparison of FIGS. 2 and 5, it will be noted that the eccentric 112 is reversable from the position shown in FIG. 2, where the knob 128 is at the front end of the backing roller 110, into the position shown in FIG. 5 where the knob 128 is at the rear end of the backing roller 110. It will be clear that in either of the selective positions of the eccentric 112 it will function in the same manner and is readily accessible for manipulation as needed. To compensate for this alternative disposition of the eccentric 112, the rearmost of the journal bores 125 in the bar 114 is utilized for the pivot 124 when the knob 128 is at the front of the roller 110, the forwardmost of the journal bores 125 is utilized for the pivot 124 when the knob 128 is at the rear of the roller 110.

In respect to the larger diameter print head 34' of FIG. 5, the type holders 51 may be the same as the type holders 51 in FIG. 1 and retained against both radial and axial displacement in similar fashion except that because of the much greater diameter of the print head 34' and therefore substantially greater diametrical spacing of the type holders on the print head, the convenient dual latching arrangement as effected by the latch member 58 in FIG. 1 may not be practical. Therefore, in respect to the print head 34', individual releasable latch members 133 are provided comprising elongate flat plates of limited length and pivotally and releasably attached to the front face of the head 34' adjacent to each of the type holder sockets 52 by means of a screw 134. By loosening the screw 134 for either of the latch members 133, the member can be rotated freely into or out of holder retaining relation. When the latch member 133 for either of the holders 51 is turned into position where it extends across the end of its type holder, and the screw 134 is tightened, the type holder will be held against axial displacement until the latch member is again released and shifted out of the retaining relation so that by means of the handle 53 the type holder 51 can be removed and replaced.

In addition to latch means movably manipulatable at the front face of the print head for releasably retaining the type holders against axial displacement from the print head, slack take-up means may be provided which will permit easy assembly tolerance between the type holder and the print head sockets, but will assure that in operation the type holders will be tightly held against vibration or wobble relative to the print head. Such an arrangement is disclosed in FIGS. 6–10 wherein print head 34'' carries two type bar holders 135 at diametrically opposite sides of the print head. Each of the type holders 135 may be geometrically similar to the type holders 51 in FIG. 1, that is having a generally elongate body having at its front end a handle 137 by which the holder is adapted to be manipulated for sliding it into or removing it from a complementary socket 138 opening through the front face and the periphery of the cylindrical print head 34''. Offset shoulders 139 along the outer edges defining the socket 138 cooperate with complementary inset rabbet groove shoulders 140 along the adjacent edges of the holder for retaining the holder against radial displacement from the assembled relation. The indicia faces of the type bars 54 project to the desired extent radially from the periphery of the print head for contact with the inking roller 64 and a workpiece supported by the back of the roller 110, in each revolution of the print head.

Retention of the holders 135 against axial displacement from their sockets 138 is effected by means of releasable swivel latches 141 comprising elongate flat plates or bars adapted to be swung manually between latching position as shown in full outline in FIGS. 6 and 7 and an unlatched, out of the way holder releasing position as shown in phantom outline in FIG. 6. Each of the latch members 141 is pivotally mounted of on the front face of the print head 34'' by being secured as by means of a set screw 142 to an axially outward projection 143 on a journal 144 rotatably received in a journal bore 145 extending axially through the head 34''.

In addition to serving as a latch journal, each of the members 144 serves as control means for a respective flat rocker bar 147 which is mounted in a chordal slot 148 intersecting the associated holder socket 138 as well as the adjacent portion of the journal bore 145, as best seen in FIGS. 9 and 10. The rocker bar 147 is of generally L-shape in elevation providing a crank lever and has an elongate leg 149 which is adapted to extend generally parallel to the root of the chordal slot 148 and rides in an annular groove 150 in the journal 144 whereby to retain the journal against unintended axial displacement from the journal bore 145. Extending angularly from one end of the leg 149 is a take-up arm 151 with a pivot 152 in the arm 151 adjacent to juncture with the leg 149 mounting the bar for rocking movement so that a shoulder lug 153 on the distal end of the arm 151 is adapted to engage the adjacent shoulder 140 of the type holder 135. The pivot 152 is desirably in the form of a pin having a threaded head **152*a* and accommodated in a bore 154 in the head 34'' intersecting the slot 148** and accessible at the front face of the print head.

Normally the rocker bar 147 is biased by means of a compression spring 154 acting on the leg 149 adjacent to its distal end whereby to thrust the leg against the journal 144 within the groove 150. When the associated latch member 141 is in the latching position, the edge of the leg 149 which engages the journal member 144 rests on an eccentric means detent flat 155 whereby the latch member is held against turning out of the latching position unless the latch member 141 is deliberately manipulated and turned out of the latching position. The arrangement is such that when the leg 149 engages in the flat 155 the lug 153 thrusts as indicated by the directional arrow 157 toward the holder 135, and the bias of the spring 154 causes inward and lateral pressure of the arm 151 and the lug 153 against the holder to tighten the holder against any slack in its socket 138. To release the take-up lug 153, concurrently with releasing the holder 135 from the latch 141, the journal member 144 turns upon turning of the latch member, and the arm 149 is caused to cam out of the flat land 155 onto the circular adjacent portion of the journal 144 in the groove 150. Thereby the arm 149 is tilted against the bias of the spring 154, as visualized in FIG. 10, rocking the bar 147 about its pivot 152 and backing the take-up lug 153 away from the shoulder 140, as indicated by the directional arrow 158.

Each of the type holders 135 is of a construction to facilitate assembling the type bars 54 therein. As best seen in FIGS. 9 and 10, the type bars 54 are of the type having interlock lugs 159 at their base ends, each of the bars having opposite its lug 159 an interlock notch 160 for receiving the lug 159 of a companion type bar. The holder 135 comprises a hollow block having a cavity 161 which is adapted to receive two internested rows of the type bars 54, with the lugs 159 of one of the row of bars engaged in an interlock groove 162 in a side wall of the holder defining the cavity 161. To facilitate mounting of the type bars 54, one side wall of the holder 135 comprises a removable panel 163 which is adapted to be registered in assembly with the body of the holder by means of pins 164 carried by the holder body and received in complementary pin holes 165 in the closure plate or panel 163.

As shown in FIGS. 11–16, type bars 167 may be mounted in rows which extend circumferentially relative to the print head, rather than in rows which extend in the axial direction of the print head as in FIGS. 1 and 6. To this end, the type bars 167, may be of generally tapered side construction toward their base ends, but have base end interlock lugs 168 and interlock notches 169, similarly as the type bars 54 previously described.

A holder 170 for the type bars 167 comprises a body 171 which is elongated in transverse direction relative to a manipulating handle 172 carried at the front of the holder. At each of its opposite ends the body 171 has generally dovetail base lug projections 173 which are received in complementary dovetail grooves 174 extending in axial direction in line with the root of a complementary holder-receiving socket **174*a* which opens through the front face and the perimeter of a circular print head 175. Mounting of the print head 175 and cooperation therewith of the inking roller 64 and the backing roller 110 may be the same as already described for the print heads 34, 34' and 34''**.

For supporting the type bars 167 in proper orientation relative to the print head 175, the holder body 171 provides a type bar cavity 176 defined by a bottom wall providing a root or base surface 177 which is on a radius of curvature concentric with the radius of curvature of the perimeter of the head 175. At each opposite end of the base surface 177 the body 171 has an end wall providing a type bar engaging shoulder surface 178 which extends on the radius of the head 175. For convenience in manufacture and assembly, the holder body is of generally U-shape structure and a front wall retainer panel 179 and a rear wall retainer panel 180 are assembed with the body 171 to complete type bar retaining closure of the type bar cavity. The front panel 179 is secured to the body 171 by means of pins 181 which may be of the familiar split tubular type.

In the front panel 179 an arcuate interlock slot 182 aligned with the base surface 177 is adapted to receive the interlock lugs 168 of one of the rows of type bars 167 adapted to be assembled substantially in the manner graphically illustrated in FIG. 16. A second row of type bars 167 is then assembled and interlocked with the first row, and so on for as many rows of the type bars as may be required. Then the rear retaining panel 180 is separably assembled with the holder body 171. Inner ends of the pins 181, or separate pins in the same holes where the body is of such thickness as to warrant, extend sufficiently beyond the inner side of the body 171 to serve as indexing means projecting slidably into pin sockets 183 in the rear wall panel 180.

Means for retaining the wall panel 180 in assembly with the body 171 and for maintaining the type bars 167 locked releasably in the holder 170, comprise a tubular tapped thimble stud 184 having an angular, preferably square head 185 which is adapted to be held against turning by opposed spaced shoulders in a complementally dimensioned recess 187 in the back surface of the panel 180. The stud 184 projects forwardly through a clearance slot 188 in the lower portion of the panel 180 and is received in a throughbore 189 in the holder body 171. For drawing the stud 184 forwardly into clamping, retaining relation to the wall panel 180, a threaded stem 190 projects rearwardly from the handle knob 172 through a clearance hole 191 in the lower portion of the wall panel 179 aligned with the bore 189. In this manner, by turning the handle knob 172, the threaded stem 190 is adapted to be threaded into the stud 184 for drawing the stud and thereby the head 185 and the back wall panel 180, registered on the pins 181, into tightly assembled relation toward the back surface of the holder body 171 and more particularly the second or inner row of type bars 167. A washer 192 is desirably interposed between the back of the knob 172 and the confronting face of the front wall panel 179.

It will be appreciated that the described construction of the holder 170 provides for quick and easy assembly and replacement of the type bars 167 in the holder. Further, by virtue of the locking up of the assembly by means of the stud 184 and the threaded stem 190, the holder with the type bars locked therein can be freely handled before assembly in the print head 175 without disassembly or spilling of the type bars. Where it is necessary to effect changes from time-to-time in the type bars 167, that can be done rapidly and efficiently. To facilitate type bar changes, the rear panel 180 may be replaceably removed by virtue of the slot 188 when the stud 184 is backed off and without disassembling the stud from the stem 190. Where indicia changes must be made frequently in a production run or consecutive production runs or repeat production runs, a number of the holders 170 may be maintained in a loaded standby condition with complete assurance that the type bars will remain positively locked against displacement from the holders.

Although any of the latching devices described, for example in respective FIG. 1 or 5, may be employed for latching the type holders 170 in the print head 175, a preferred arrangement, in this instance, comprises retaining the holders 170 magnetically. For this purpose, the plate or panel 180 may be made from a ferromagnetic material such as cold rolled steel so that a retaining magnet 193 mounted at the inner end of the holder-receiving socket 174A will releasably retain the holder 170 in such socket. Desirably the magnet 193 may be mounted in a carrier formed from a non-magnetic material such as aluminum and shaped substantially like the type holder body 171 so that the carrier 194 is adapted to be mounted in the socket 174A in similar manner as the type holder. For retaining the magnet carrier 194 in place in the socket 174A, securing means such as a screw 195 may be provided by which the carrier 194 is adapted to be secured fixedly to the print head 175. As a result, the type holder 170, with the type bars 167 locked therein may easily and conveniently be assembled with the print head 175 by sliding the type holder into the socket 174 and the type holder will then be positively retained in the type holder socket during printing operation. When it is desired to remove the type holder 170, it may simply be manually withdrawn by pulling on the handle 172 for overcoming the magnetic attraction of the magnet 193. It will be appreciated that the location of the magnet 193 may be anywhere in the magnet carrier 194 most convenient to the ferromagnetic retainer panel 180. That is although the magnet 193 is shown in FIG. 13 for convenience as aligned with the recess 187, the magnet 193 may be located in the carrier 194 either to the left or to the right of the position shown, the principal requirement being that the front of the magnet be opposed to the back of the panel 180 so that type holder retaining magnetic attraction of the magnet will occur.

In FIG. 4A is shown a slight modification in respect to the means for mounting the inking roll 64' which may be somewhat shorter than the inking roll 64 in FIG. 2, where the type bars 54' occupy less space for the intended imprinting operation than the full capability of the type holder. To this end, the inking roll 64' may be, except for its length, of substantially the same construction and mounted for operation in substantially the same manner as the inking roll 64. To permit axial adjustments for different imprinting requirements, the hub 67' on which the inking roll 64' is mounted is provided with a pair of adjacent axially spaced latching grooves 69' in which are retainingly engageable latch plates 99' of which only one is shown in FIG. 4A but which function in substantially the same manner as the latch plates 99 in FIG. 1. The axially outermost of the grooves 69' is defined between the inner end of the handle knob 68' and a radial spacer flange 197 while the next adjacent of the grooves 69' is defined between that flange 197 and a second such flange 197 spaced therefrom. Desirably an annular air space groove 198 intervenes between the innermost of the flanges 197 and the thrust shoulder flange 70' against which the outer end of the pigment carrying roll 64' is adapted to abut. To facilitate axial adjustment of the inking roll assembly to and between the two positions indicated by the full line and dash line positions in FIG. 4A, the interdigitated slidably adjustable coupling fingers 72′ and 73′ are desirably somewhat longer than, for example, in FIG. 2. Through this arrangement, the axial position of the inking roll 64′ is easily adjusted for either of the two axial positions by selectively engaging the latch plates 99′ in either of the grooves 69′. Removal and replacement of the inking roll 64′ may be effected in the expeditious manner described for the roll 64 in FIG. 2.

It will be understood that variations and modifications may be effected without departing from the spirit and scope of the novel concepts of this invention.

I claim as my invention:

1. A rotary head imprinter including a frame, and comprising:

a shaft rotatably supported by said frame and means for rotatably driving the shaft;

a print head mounting block carried by said shaft;

a print head and means for releasably securing said print head to said mounting block and thereby to said shaft;

a rotary inking roller and means for mounting the inking roller on said frame on an axis parallel to the axis of said shaft for rolling engagement with printing means carried by said print head;

a backing roller and means for mounting the backing roller on said frame on a rotary axis parallel to said shaft axis for supporting a workpiece for imprinting by the inked printing means carried by said printing head;

means for effecting adjustments of said inking roller mounting means and said backing roller mounting means radially relative to said shaft for enabling cooperation of said inking roller and said backing roller with printing heads of selected different diameters;

said means for mounting said backing roller on said frame comprising a non-rotating shaft, a tubular eccentric slidably engaged on said shaft and providing means for rotatably supporting said backing roller, said eccentric being selectively rotatably adjustable on said non-rotating shaft for adjusting said backing roller relative to said print head, and a combination adjusting knob and locking clamp on one end of said eccentric for locking the eccentric in any selected rotatably adjusted position on said non-rotating shaft;

means on said print head providing an axially extending and peripherally radially opening slot having an entrance at a front face of said print head for receiving printing means including a type holder, means for retaining the type holder against radial displacement from said slot, and means for releasably retaining said type holder against axial displacement from said slot; and said type holder comprising a body adapted for mounting in said slot in the print head and having a cavity defined by a base wall and spaced end walls and adapted for supporting type bar means on said base wall between said end walls, means providing opposite type bar means retaining walls for said cavity, means for locking said type bar means in said cavity, at least one of said side walls being separable from said body to permit mounting and replacement of said type bar means in said cavity, and means for releasably retaining said one side wall in assembled relation with said body.

2. A rotary head imprinter including a frame, and comprising:

a shaft rotatably supported by said frame and means for rotatably driving the shaft, said shaft terminating at one end with a mounting block having front face;

a rotary print head having a rear face and means for releasably corotatively securing said rear face of said print head to said front face of said mounting block in face-to-face abutment with said shaft;

a rotary inking roll and shaft means for mounting the inking roll on said frame on an axis parallel to the axis of said shaft for rolling engagement with printing means carried by said print head;

a backing roller and means for mounting the backing roller on said frame on a rotary axis parallel to said shaft axis for supporting a workpiece for imprinting by the inked printing means carried by said printing head;

means for effecting adjustments of said inking roll shaft means and said backing roller mounting means radially relative to said shaft for enabling cooperation of said inking roll and said backing roller with print heads of selected different diameters;

means fixed on said print head spaced from said printing means and providing a driving rotatable surface;

roll driving means on said inking roll shaft means providing a driven rotatable surface;

said driving rotatable surface and said driven rotatable surface engaging each other to rotate said roll driving shaft means in dependent response to rotation of said print head; and means coupling said inking roll removeably to said roll driving shaft means for rotation therewith;

said print heads of selected different diameters having driving surfaces of similar different diameters as said print heads.

3. An imprinter according to claim 2, wherein said frame has vertically extending supporting structure, and said means for effecting adjustments of both said inking roll mounting means and said backing roller mounting means comprising bolts, and means on said structures for receiving said bolt at selected elevations.

4. An imprinter according to claim 3, wherein said means for receiving said bolts at select elevations comprises vertical slots along which the bolts are adapted to be received at selected elevations of the mounting means.

5. An imprinter according to claim 3, wherein said means for receiving said bolts comprises a vertical series of bolt holes in which the bolts are selectively receivable.

6. An imprinter according to claim 2, wherein said means for effecting adjustments of said inking roll mounting means comprises a mounting block, and means for adjustably securing said mounting block at selected elevations on said frame.

7. A rotary head imprinter including a frame, and comprising:

a shaft rotatably supported by said frame and means for rotatably driving the shaft;

a rotary print head and means for releasably corotatively securing said print head to said shaft;

a rotary inking roll and shaft means for mounting the inking roll on said frame on a rotary axis parallel to the axis of said shaft for rolling engagement with printing means carried by said print head;

a backing roller and means for mounting the backing roller on said frame on a rotary axis parallel to said shaft axis for supporting a workpiece for imprinting by the inked printing means carried by said printing head, said means for mounting said backing roller comprising a non-rotating shaft, a tubular eccentric slidably engaged on said shaft and providing means for rotatably supporting said backing roller, said eccentric being selectively rotatably adjustable on said shaft for adjusting said backing roller relative to said print head, and a combination adjusting knob and locking clamp on one end of said eccentric for locking the eccentric in any selected rotatably adjusted position on the shaft;

means for effecting adjustments of said inking roll shaft means and said backing roller mounting means radially relative to said shaft for enabling cooperation of said inking roll and said backing roller with print heads of selected different diameters;

means fixed on said print head spaced from said printing means and providing a driving rotatable surface;

roll driving means on said inking roll shaft means providing a driven rotatable surface;

said driving rotatable surface and said driven rotatable surface engaging each other to rotate said roll driving shaft means in dependent response to rotation of said print head;

and means coupling said inking roll removeably to said roll driving shaft means for rotation therewith;

said print heads of selected different diameters having driving surfaces of similar different diameters as said print heads.

8. A rotary head imprinter including a frame, and comprising:

a shaft rotatably supported by said frame and means for rotatably driving the shaft;

a rotary print head and means for releasably corotatively securing said print head to said shaft;

a rotary inking roll and shaft means for mounting the inking roll on said frame on an axis parallel to the axis of said shaft for rolling engagement with printing means carried by said print head;

a backing roller and means for mounting the backing roller on said frame on a rotary axis parallel to said shaft axis for supporting a workpiece for imprinting by the inked printing means carried by said printing head, said means for mounting said backing roller comprising a mounting arm having a longitudinal slot opening toward said backing roller, a bar received in said slot having a shaft extension and means rotatably mounting said backing roller on said shaft extension, means pivotally mounting said bar in said slot, means for adjusting the pivotal attitude of said bar in said slot for fine adjustment of the position of said backing roller, and means for securing said mounting arm in selected vertical positions on said frame for coarse adjustment of the position of said backing roller;

means for effecting adjustments of said inking roll shaft means and said backing roller mounting means radially relative to said shaft for enabling cooperation of said inking roll and said backing roller with print heads of selected different diameters;

means fixed on said print head spaced from said printing means and providing a driving rotatable surface;

roll driving means on said inking roll shaft means providing a driven rotatable surface;

said driving rotatable surface and said driven rotatable surface engaging each other to rotate said roll driving shaft means in dependent response to rotation of said print head; and means coupling said inking roll removeably to said roll driving shaft means for rotation therewith;

said print heads of selected different diameters having driving surfaces of similar different diameters as said print heads.

9. A rotary head imprinter including a frame, a rotary print head, an inking roll cooperating with said print head and a backing roller cooperating with said print head, and comprising:

means for mounting said backing roller on said frame and comprising a non-rotating shaft;

a tubular eccentric slidably engaged on said shaft and providing means for rotatably supporting said backing roller;

said eccentric being selectively rotatably adjustable on said shaft for adjusting said backing roller relative to said print haad;

a combination adjusting knob and locking clamp on one end of said eccentric for locking the eccentric in any selected rotatably adjusted position on the shaft; and means for releasably locking said combination adjusting knob and locking clamp to said shaft.

10. An imprinter according to claim 9, wherein said shaft is longer than said tubular eccentric and said tubular eccentric is reversible end-for-end on said non-rotating shaft and relative to said backing roller, for defining by the location of said combination adjusting knob and locking clamp at either end of said backing roller the axial position of the roller on said shaft.

11. An imprinter according to claim 9, wherein said non-rotating shaft comprises an extension on a bar, means for rockably supporting said bar for adjustment about a horizontal axis for adjusting said backing roller relative to said print head, and means for securing said bar in adjusted position.

12. An imprinter according to claim 11, wherein said rockably supporting means comprises an arm, and means for effecting vertical adjustments of said arm relative to said frame.

13. A rotary head imprinter including a rotary print head, an inking roll cooperating with said print head and a backing roller cooperating with said print head, and comprising:

means on said print head providing an axially extending and peripherally radially opening socket having an entrance at a front face of said print head for receiving a type holder;

means for retaining the type holder against radial displacement from said socket;

means manipulatable at said front face of said print head for axial mounting and removal of said type holder relative to said socket;

means releasably retaining said type holder in said socket for imprinting operation;

said retaining means comprising a latch plate;

means pivotally mounting said latch plate at said front face and comprising a journal extending into a journal bore in said head;

means controlled by rotation of said journal for locking said holder against looseness in said slot;

said locking means comprising a pivoted crank lever having a locking arm releasably engageable with said holder and a leg of the lever engaged in an annular groove in said journal and thereby retaining said journal in axial assembly in said bore; and eccentric means on said journal in said groove for rockably controlling said leg and thereby said arm in response to rotary movements of said shaft.

14. An imprinter according to claim 13, wherein said retaining means comprises a swively mounted latch member on said front face, and means for releasably retaining said latch member in latching position relative to said type holder.

15. An imprinter according to claim 14, wherein said means for maintaining the latch member in latching position comprises a biasing spring.

16. An imprinter according to claim 14, wherein said means for releasably retaining said latch member comprises a releasable screw.

17. An imprinter according to claim 13, including biasing means normally biasing said lever rockably into the holder locking position of said arm.

18. A type holder received in a recess having a rear face in a print head of an imprinter, comprising:

a type holder body shaped for mounting in said recess of the print head and having a cavity defined by a base, spaced side walls and spaced end walls for holding a plurality of type-carrying printing bars on a top surface of said base between said end walls, each said printing bar having side faces and having a projecting lug on one of the side faces and a lug-receiving notch on the opposite side face;

a lug-receiving notch in at least one of said walls of said cavity for receiving said lug of a printing bar for locking said printing bar in said cavity;

first and second spaced retaining walls disposed on opposite sides of said base between said end walls and having respective portions extending beyond said top surface of said base forming said side walls of said cavity;

a plurality of spaced pins carried on one of said retaining walls, said base and the other of said retaining walls having respective bores in registry for receiving said pins and aligning said retaining walls and said base;

said first retaining wall disposed against said rear face of said recess and having a further bore extending therethrough in registry with respective further bores in said base and said second retaining wall;

an interiorly-threaded thimble having a head non-rotatably received in an enlarged portion of said further bore of said first retaining wall and extending at least into said further bore of said base; and a handle for said holder having a threaded stem extending through said second retaining wall and at least into said further bore in said base and threadedly engaged with said thimble for releasably clamping said retaining walls to said base.

19. A rotary head imprinter including a frame, a rotary print head, an inking roll cooperating with said print head and a backing roller cooperating with said print head, and comprising:

a shaft rotatably supported by the frame and means for rotatably driving the shaft;

a print head mounting block carried by said shaft;

means for releasably securing said print head to said mounting block;

said mounting block carrying heating means and having a forwardly facing heat exchange surface;

said print head having a rearwardly facing heat exchange surface engageable in heat transfer abutment with said mounting block surface;

a centering boss projecting from one of said surfaces into a recess in the other of said surfaces; and a pair of screws extending through said print head and threaded into said mounting block at opposite sides of said centering boss.

20. A rotary head imprinter including a frame, and comprising:

a shaft rotatably supported by said frame and means for rotatably driving the shaft;

a rotary print head and means for releasably securing said print head to said shaft;

a rotary inking roll and shaft means for mounting the inking roll on said frame on an axis parallel to the axis of said shaft for rolling engagement with printing means carried by said print head;

a backing roller and means for mounting the backing roller on said frame on a rotary axis parallel to said shaft axis for supporting a workpiece for imprinting by the inked printing means carried by said printing head;

means for effecting adjustments of said inking roll shaft means and said backing roller mounting means radially relative to said shaft for enabling cooperation of said inking roll and said backing roller with print heads of selected different diameters;

said backing roller mounting means comprising a mounting arm and means for securing said mounting arm in selected vertical positions on said frame to accommodate said printing heads of different diameters;

said arm having a longitudinal slot opening toward said backing roller;

a bar received in said slot;

means pivotally mounting said bar in said slot;

means for adjusting the pivotal attitude of said bar in said slot;

a shaft extension on said bar; and means mounting said backing roller rotatably on said shaft extension.

21. A rotary head imprinter, comprising:

a frame having a pair of vertical panels one of which is a lower panel and the other of which is an upper panel;

means securing a lower portion of said upper panel in forwardly offset relation to an upper portion of said lower panel and with the remainder of said upper panel extending upwardly relative to the upper end of said lower panel;

a print head having a shaft extending rearwardly and journaled in spanning relation through said lower portion of said upper panel and said upper portion of said lower panel and with a portion of said shaft extending rearwardly from said upper portion of said lower panel and having means thereon for driving said shaft rotatably;

means mounting inking roll means to said remainder of said upper panel in a position for inking cooperation with said print head;

means for mounting a backing roller to said lower panel below the lower edge of said upper panel and with the backing roller cooperative with said print head for supporting material to be imprinted in imprinting relation to said print head;

means for rotatably driving said inking roll means in response to rotation of said print head;

means for vertically adjusting the inking roll means mounting means along said upper panel and relative to said print head; and means for vertically adjusting said backing roller mounting means along said lower panel and relative to said print head;

said vertical adjustment means enabling cooperation of said inking roller means and said backing roll with print heads of selected different diameters.

22. A rotary head imprinter according to claim 21, including electrical means for heating said print head, and means carried by said print head shaft and including a commutator on said shaft in a space between said upper portion of said lower panel and said lower portion of said upper panel for transfer of electricity to said electrical means.

23. An imprinter according to claim 21, wherein said inking roll means comprises a roll carried rotatably on a non-rotary shaft, a heating block having a chamber about said inking roll, a mounting block, means vertically adjustably attaching said mounting block to said upper panel, an intermediate block, means attaching said non-rotating shaft to said intermediate block, and screws securing said heating block and said intermediate block to said mounting block.

24. An imprinter according to claim 23, including means between said heater block and said intermediate block for retarding heat transfer from said heater block to said intermediate block.

* * * * *